US006952936B2

(12) United States Patent
Sannasi et al.

(10) Patent No.: US 6,952,936 B2
(45) Date of Patent: Oct. 11, 2005

(54) REFRIGERATOR AND ICE MAKER APPARATUS

(75) Inventors: Ashok Kumar Sannasi, Louisville, KY (US); Scott Russell King, Prospect, KY (US); Ramesh Janardhanam, Louisville, KY (US); Lorina June White, Louisville, KY (US); James Armstrong, Louisville, KY (US); Daniel Stephen Renz, Louisville, KY (US); Anthony Cooper, Louisville, KY (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 10/743,123

(22) Filed: Dec. 22, 2003

(65) Prior Publication Data

US 2005/0132739 A1 Jun. 23, 2005

(51) Int. Cl.[7] ..... F25C 5/18

(52) U.S. Cl. ..... 62/344; 198/550.1; 222/413

(58) Field of Search ..... 62/344; 198/671, 198/550.1; 222/146.6, 413

(56) References Cited

U.S. PATENT DOCUMENTS

| | | | | |
|---|---|---|---|---|
| 4,084,725 | A * | 4/1978 | Buchser | 221/75 |
| 4,694,661 | A * | 9/1987 | Landers | 62/344 |
| 4,881,862 | A * | 11/1989 | Dick | 414/218 |
| 4,997,109 | A * | 3/1991 | Carper | 222/146.6 |
| 5,037,004 | A * | 8/1991 | Katz et al. | 222/146.6 |
| 5,117,654 | A * | 6/1992 | Steffenhagen | 62/344 |
| 5,273,219 | A | 12/1993 | Beach, Jr. et al. | |
| 5,910,164 | A * | 6/1999 | Snelling et al. | 62/344 |
| 6,334,318 | B1 | 1/2002 | Ando et al. | |
| 6,427,456 | B2 | 8/2002 | Niwa et al. | |
| 6,442,954 | B1 * | 9/2002 | Shapiro et al. | 62/137 |
| 6,574,974 | B1 | 6/2003 | Herzog et al. | |
| 6,655,166 | B1 * | 12/2003 | Williams | 62/320 |

* cited by examiner

*Primary Examiner*—William E Tapolcai
(74) *Attorney, Agent, or Firm*—H. Neil Houser, Esq.; Armstrong Teasdale LLP

(57) ABSTRACT

An ice maker assembly includes, in an exemplary embodiment, an ice bucket that has a bottom wall, opposing side walls extending from the bottom wall, a front wall, and a back wall. The bottom wall, side walls, front wall, and back wall define an ice collection cavity. The ice bucket also includes a plurality of ribs extending from the bottom wall into the ice collection cavity, and a rotatable auger extending between the front and back walls.

16 Claims, 7 Drawing Sheets

REFRIGERATOR AND ICE MAKER APPARATUS

BACKGROUND OF THE INVENTION

This invention relates generally to refrigerators, and more specifically, to an ice making system for a refrigerator.

Some known refrigerators include a fresh food compartment and a freezer compartment. Such refrigerators also typically include a refrigeration circuit including a compressor, evaporator, and condenser connected in series. An evaporator fan is provided to blow air over the evaporator, and a condenser fan is provided to blow air over the condenser. In operation, when an upper temperature limit is reached in the freezer compartment, the compressor, evaporator fan, and condenser fan are energized. Once the temperature in the freezer compartment reaches a lower temperature limit, the compressor, evaporator fan, and condenser fan are de-energized.

Some refrigerator freezers include an ice maker. The ice maker receives water for ice production from a water valve typically mounted to an exterior of a refrigerator case. A primary mode of heat transfer for making ice is convection. Specifically, by blowing cold air over an ice maker mold body, heat is removed from water in the mold body. As a result, ice is formed in the mold. Typically, the cold air blown over the ice maker mold body is first blown over the evaporator and then over the mold body by the evaporator fan. The ice is typically stored in an ice bucket positioned adjacent the mold. Known ice buckets do not permit easy access to bulk ice removal, due to interference with the inner door when the refrigerator is adjacent to a wall, especially for "built-in: style refrigerators.

BRIEF DESCRIPTION OF THE INVENTION

In one aspect, an ice maker assembly for a refrigerator is provided. The ice maker assembly includes an ice bucket that includes a bottom wall, opposing side walls extending from the bottom wall, a front wall, and a back wall. The bottom wall, side walls, front wall, and back wall define an ice collection cavity. The ice bucket also includes a plurality of ribs extending from the bottom wall into the ice collection cavity, and a rotatable auger extending between the front and back walls.

In another aspect, an ice maker assembly for a refrigerator is provided. The ice maker assembly includes an ice bucket including a bottom wall, opposing side walls extending from the bottom wall, a front wall, and a back wall. The bottom wall, side walls, front wall, and back wall define an ice collection cavity. The ice bucket also includes a rotatable auger extending between the front and back walls, and an auger drive cup. The auger drive cup includes a circular ring portion having an inner surface and an outer surface. The drive cup is positioned in an opening in the back wall with the outer surface rotatably coupled to the back wall. The auger drive cup is operatively coupled to the auger. A drive post extends radially from the inner surface of the circular ring portion. The drive post includes a tapered surface facing away from the auger.

In another aspect, a refrigerator is provided. The refrigerator includes a fresh food compartment, a freezer compartment having a back wall and separated from the fresh food compartment by a mullion, a first glide track and an opposing second glide track mounted in the freezer compartment, and an ice maker positioned within the freezer compartment. The ice maker including an ice bucket slidably mounted in the freezer cavity. The ice bucket is tiltable to a downward slope from the back wall to permit access to an ice collection cavity of the ice bucket. The ice bucket includes front slide nubins and rear slide nubins extending from a first side and an opposing second side of the ice bucket. The front and rear slide nubins are sized to slide in the glide tracks. Each glide track include a track stop that acts as pivot points for tilting the ice bucket, and a tilt stop portion that engages the rear nubin to limit the amount of tilt and hold the ice bucket in place when tilted downward.

DETAILED DESCRIPTION OF THE INVENTION

Figure 1:
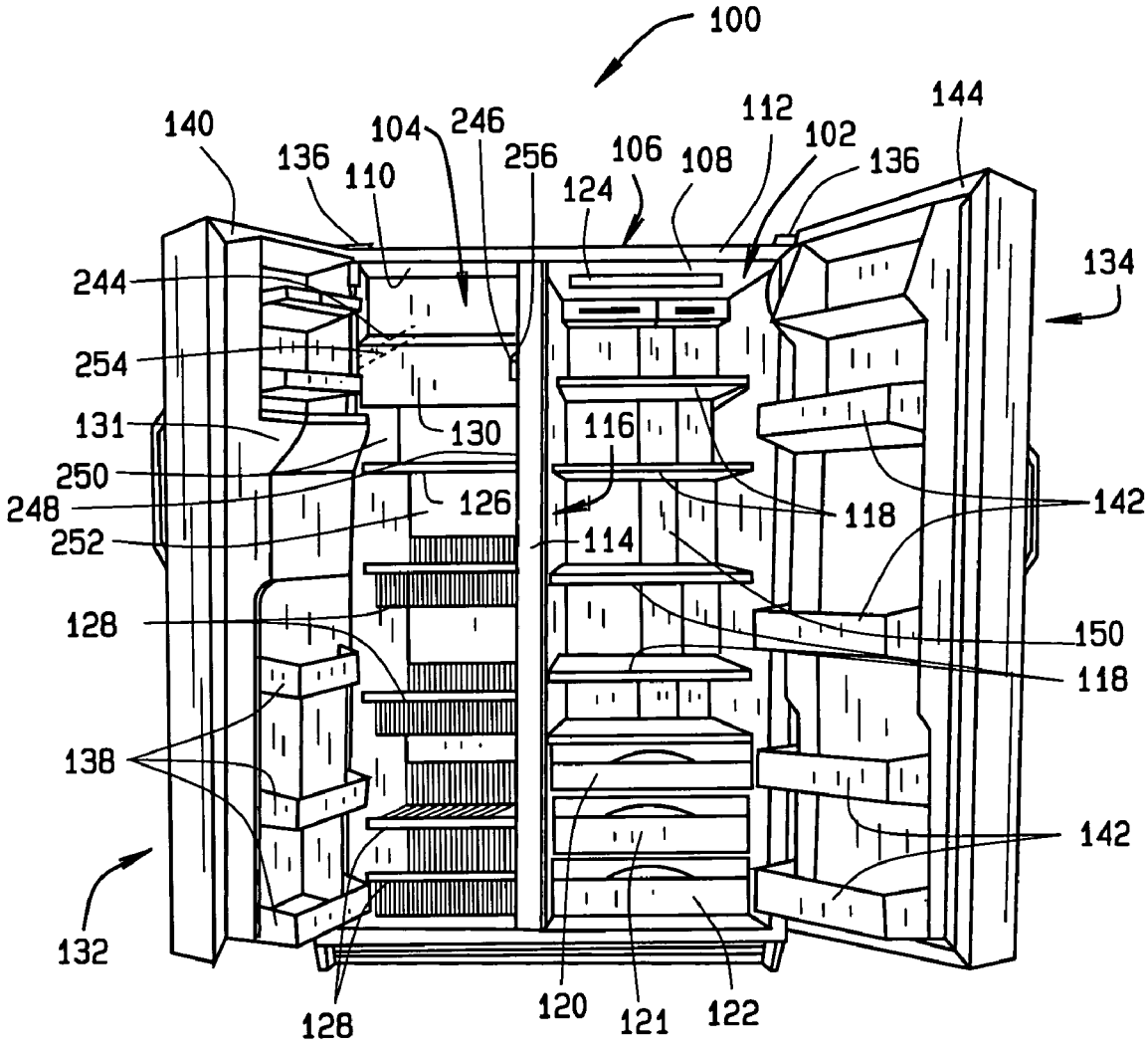
FIG. 1 is a perspective view of an exemplary refrigerator.

FIG. 1 illustrates an exemplary refrigeration appliance 100 in which the present invention may be practiced. In the embodiment described and illustrated herein, appliance 100 is a side-by-side refrigerator. It is recognized, however, that the benefits of the present invention are equally applicable to other types of refrigerators, freezers, and refrigeration appliances. Consequently, the description set forth herein is for illustrative purposes only and is not intended to limit the invention in any aspect.

Refrigerator 100 includes a fresh food storage compartment 102 and a freezer storage compartment 104 contained within an outer case 106 and inner liners 108 and 110. A space between case 106 and liners 108 and 110, and between liners 108 and 110, is filled with foamed-in-place insulation. Outer case 106 normally is formed by folding a sheet of a suitable material, such as pre-painted steel, into an inverted U-shape to form top and side walls of case. A bottom wall of case 106 normally is formed separately and attached to the case side walls and to a bottom frame that provides support for refrigerator 100. Inner liners 108 and 110 are molded from a suitable plastic material to form freezer compartment 104 and fresh food compartment 102, respectively. Alternatively, liners 108, 110 may be formed by bending and welding a sheet of a suitable metal, such as steel. The illustrative embodiment includes two separate liners 108, 110 as it is a relatively large capacity unit and separate liners add strength and are easier to maintain within manufacturing tolerances. In smaller refrigerators, a single liner is formed and a mullion spans between opposite sides of the liner to divide it into a freezer compartment and a fresh food compartment.

A breaker strip 112 extends between a case front flange and outer front edges of liners. Breaker strip 112 is formed from a suitable resilient material, such as an extruded acrylonitrile-butadiene-styrene based material (commonly referred to as ABS).

The insulation in the space between liners 108, 110 is covered by another strip of suitable resilient material, which also commonly is referred to as a mullion 114. Mullion 114 also preferably is formed of an extruded ABS material. Breaker strip 112 and mullion 114 form a front face, and extend completely around inner peripheral edges of case 106 and vertically between liners 108, 110. Mullion 114, insulation between compartments, and a spaced wall of liners separating compartments, sometimes are collectively referred to herein as a center mullion wall 116.

Shelves 118 and slide-out drawers 120 normally are provided in fresh food compartment 102 to support items being stored therein. A bottom drawer or pan 122 may partly form a quick chill and thaw system (not shown) and selectively controlled, together with other refrigerator features, by a microprocessor (not shown) according to user preference via manipulation of a control interface 124 mounted in an upper region of fresh food storage compartment 102 and coupled to the microprocessor. A shelf 126 and wire baskets 128 are also provided in freezer compartment 104.

Freezer compartment 104 includes an automatic ice maker 130. An ice dispenser 131 is provided in freezer door 132 so that ice can be obtained without opening freezer door 132. As will become evident below, ice maker 130, in accordance with conventional ice makers includes a number of electromechanical elements that manipulate a mold to shape ice as it freezes, a mechanism to remove or release frozen ice from the mold, and a primary ice bucket for storage of ice produced in the mold. Periodically, the ice supply is replenished by ice maker 130 as ice is removed from the primary ice bucket. The storage capacity of the primary ice bucket is generally sufficient for normal use of refrigerator 100.

Freezer door 132 and a fresh food door 134 close access openings to fresh food and freezer compartments 102, 104, respectively. Each door 132, 134 is mounted by a top hinge 136 and a bottom hinge (not shown) to rotate about its outer vertical edge between an open position, as shown in FIG. 1, and a closed position (not shown) closing the associated storage compartment. Freezer door 132 includes a plurality of storage shelves 138 and a sealing gasket 140, and fresh food door 134 also includes a plurality of storage shelves 142 and a sealing gasket 144.

In accordance with known refrigerators, refrigerator 100 also includes a machinery compartment (not shown) that at least partially contains components for executing a known vapor compression cycle for cooling air. The components include a compressor (not shown), a condenser (not shown), an expansion device (not shown), and an evaporator (not shown) connected in series and charged with a refrigerant. The evaporator is a type of heat exchanger which transfers heat from air passing over the evaporator to a refrigerant flowing through the evaporator, thereby causing the refrigerant to vaporize. The cooled air is used to refrigerate one or more refrigerator or freezer compartments via fans (not shown). Collectively, the vapor compression cycle components in a refrigeration circuit, associated fans, and associated compartments are referred to herein as a sealed system. The construction of the sealed system is well known and therefore not described in detail herein, and the sealed system is operable to force cold air through the refrigerator.

Figure 2:
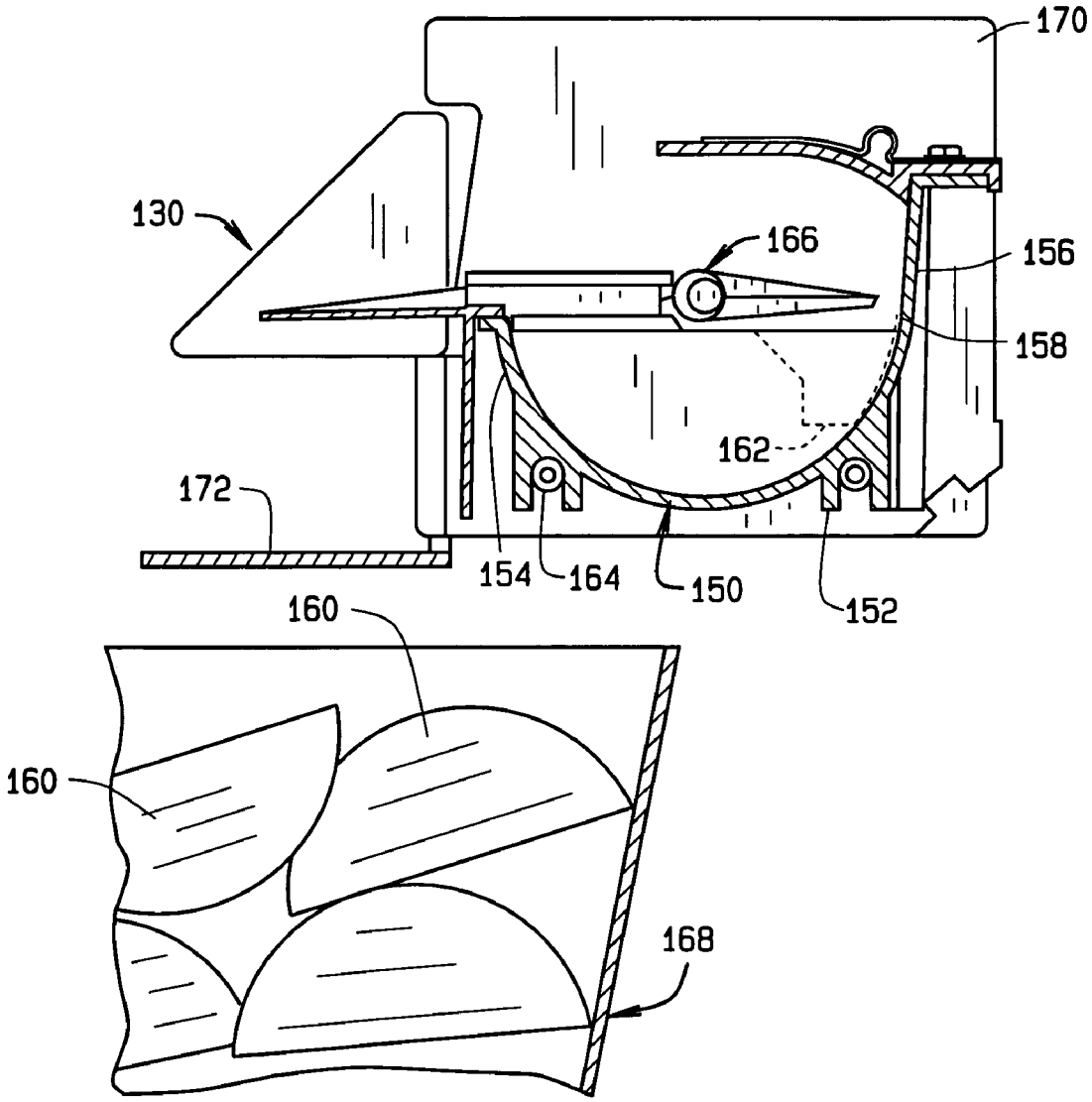
FIG. 2 is a cross-sectional view of an exemplary ice maker in the refrigerator shown in FIG. 1.

FIG. 2 is a cross sectional view of an icemaker 130 including a metal mold 150 with a tray structure having a bottom wall 152, a front wall 154, and a back wall 156. A plurality of partition walls 158 extend transversely across mold 150 to define cavities in which ice pieces 160 are formed. Each partition wall 158 includes a recessed upper edge portion 162 through which water flows successively through each cavity to fill mold 150 with water.

A sheathed electrical resistance heating element 164 is press-fit, staked, and/or clamped into bottom wall 152 of mold 150 and heats mold 150 when a harvest cycle is executed to slightly melt ice pieces 160 and release them from the mold cavities. A rotating rake 166 sweeps through mold 150 as ice is harvested and ejects ice from mold 150 into a storage bin 168 or ice bucket. Cyclical operation of heater 164 and rake 166 are effected by a controller 170 disposed on a forward end of mold 150, and controller 170 also automatically provides for refilling mold 150 with water for ice formation after ice is harvested through actuation of a water valve (not shown in FIG. 2) connected to a water source (not shown) and delivering water to mold 150 through an inlet structure (not shown).

In order to sense a level of ice pieces 160 in storage bin, 168 controller actuates a cam-driven feeler arm 172 rotates underneath icemaker 130 and out over storage bin 168 as ice is formed. Feeler arm 172 is spring biased to an outward or "home" position that is used to initiate an ice harvest cycle, and is rotated inward and underneath icemaker by a cam slide mechanism (not shown) as ice is harvested from icemaker mold 150 so that the feeler arm does not obstruct ice from entering storage bin 168 and to prevent accumulation of ice above the feeler arm. After ice is harvested, the feeler arm is rotated outward from underneath icemaker 130, and when ice obstructs the feeler arm and prevents the feeler arm from reaching the home position, controller 170 discontinues harvesting because storage bin 168 is sufficiently full. As ice is removed from storage bin 168, feeler arm 172 gradually moves to its home position, thereby indicating a need for more ice and causing controller 170 to initiate formation and harvesting of ice pieces 160.

Figure 3:
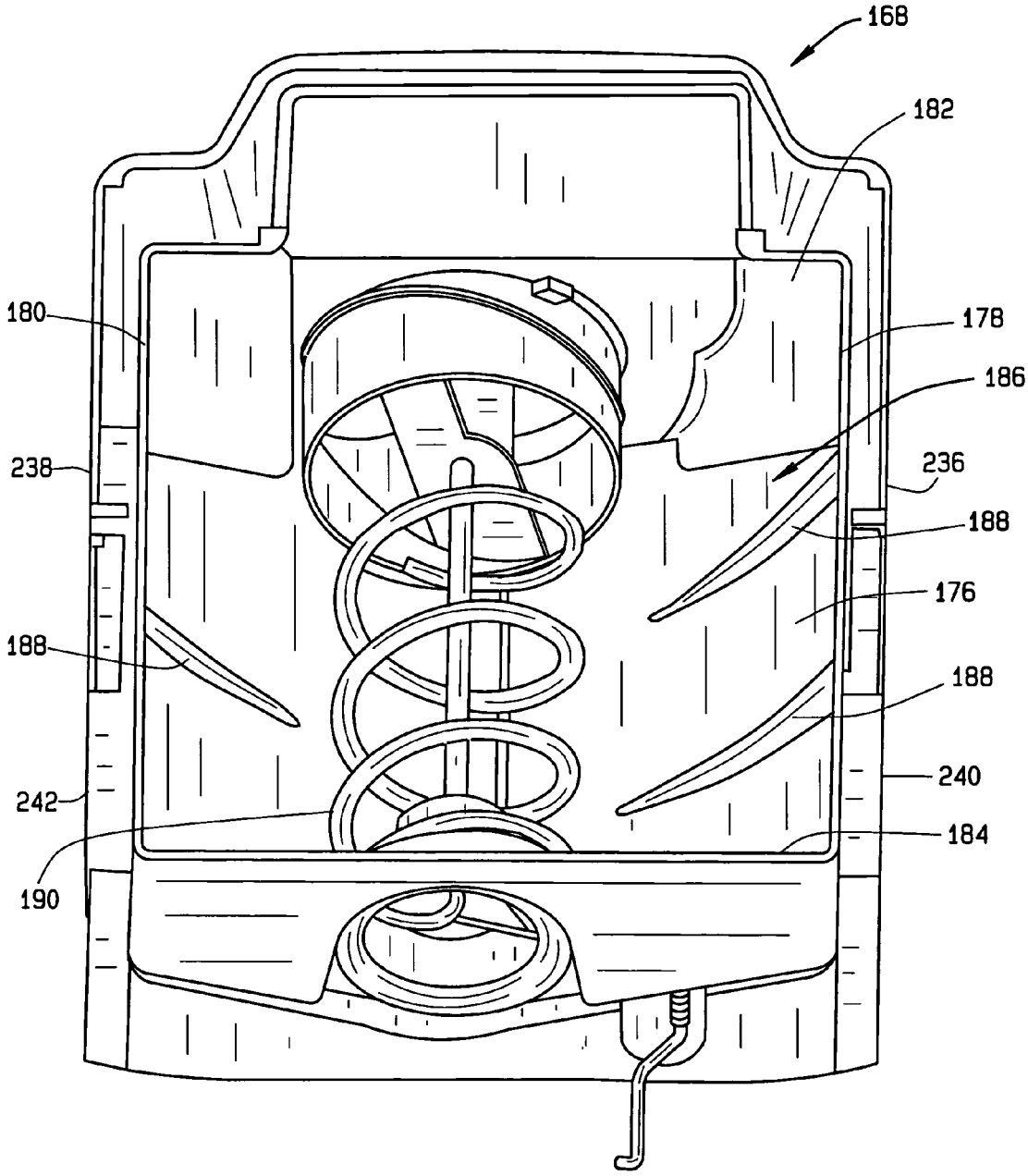
FIG. 3 is a top perspective view of the ice bucket shown in FIG. 2.
Figure 4:
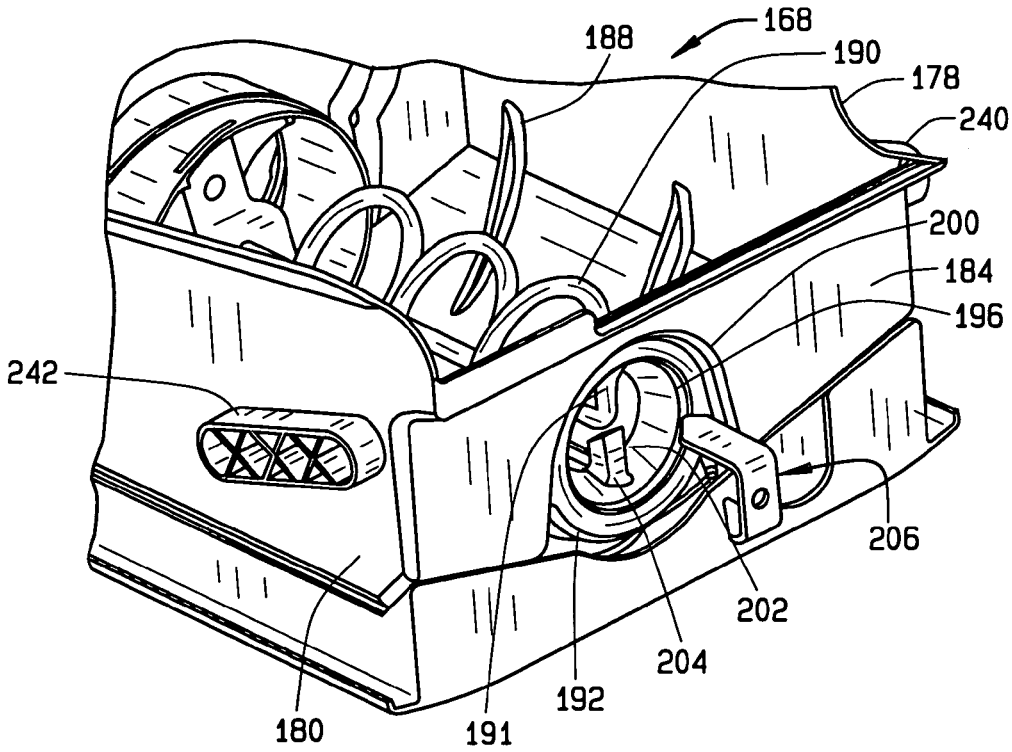
FIG. 4 is a rear perspective view of the ice bucket shown in FIGS. 2 and 3.
Figure 5:
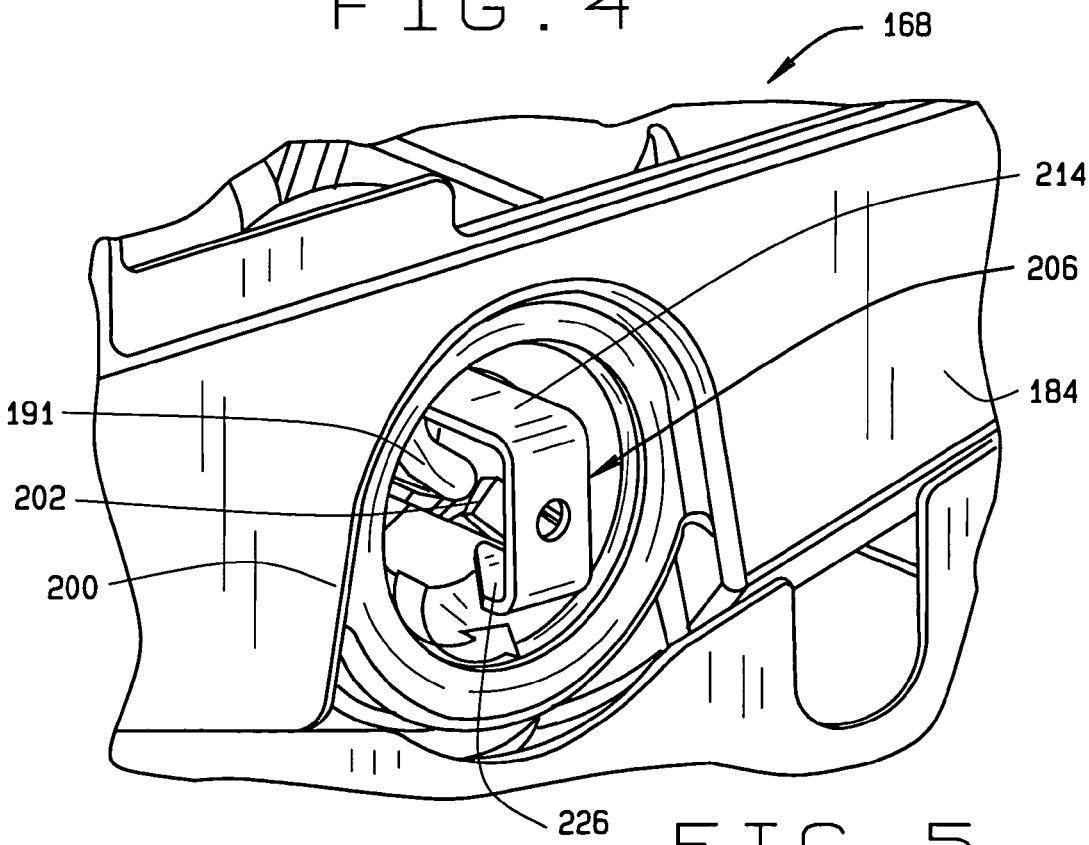
FIG. 5 is an enlarged rear view of the ice bucket shown in FIGS. 2–4.

FIG. 3 is a top perspective view of ice bucket 168, FIG. 4 is a rear perspective view of ice bucket 168, and FIG. 5 is an enlarged rear view of the ice bucket 168. Referring to FIGS. 3–5, ice bucket 168 includes a bottom wall 176, opposing side walls 178 and 180, a front wall 182, and a back wall 184. Bottom wall 176, side walls 178 and 180, front wall 182, and back wall 184 define an ice collection cavity 186. A plurality of ribs 188 extend from bottom wall 182 into ice collection cavity 186. A rotatable auger 190 extends between front and back walls 182 and 184. Each rib 188 extends from side wall 178 or 180 towards auger 190, and each rib 188 is tapered from side wall 178 or 180. Ribs 188 aid in guiding ice pieces 160 into auger 190 for dispensing. Ribs 188 also maintain ice cubes 160 in position within ice collection cavity 186 and create a "positive pressure" to assist in feeding ice cubes 160 into auger 190. Ribs 188 further act to break ice pile forces to permit ice to feed into auger 190, and act to break the ice into sections to permit the sections of ice to act independently.

Figure 6:
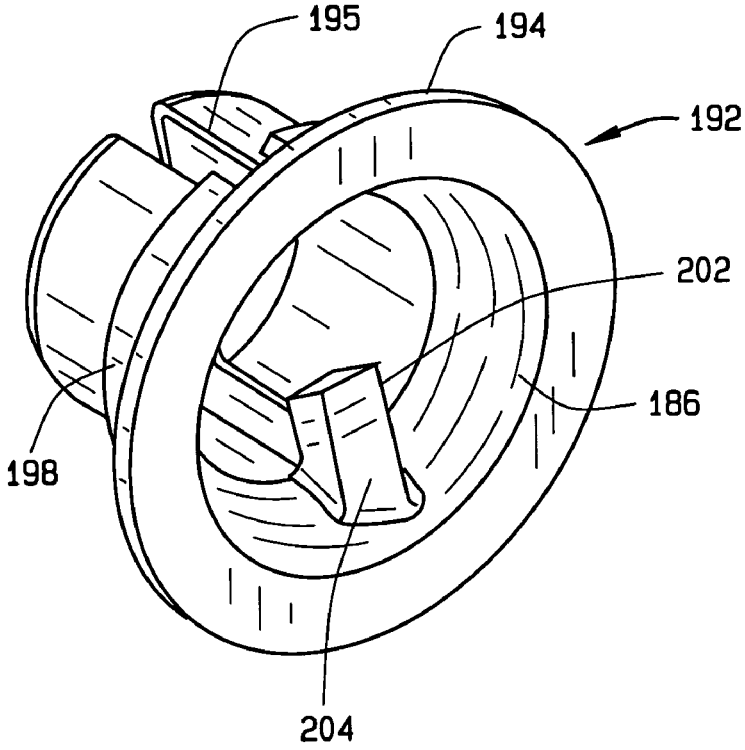
FIG. 6 is a perspective view of the auger drive cup shown in FIGS. 3–5.
Figure 7:
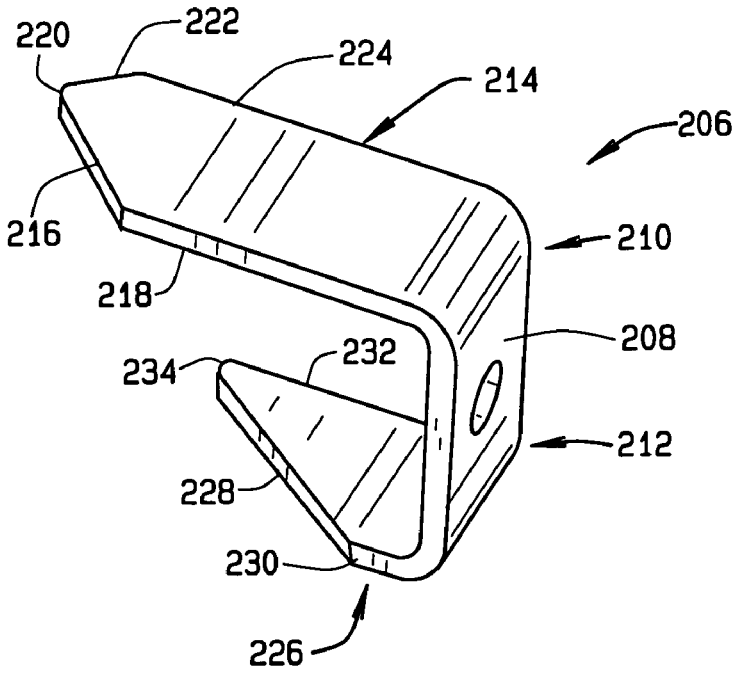
FIG. 7 is a perspective view of the drive fork shown in FIGS. 4 and 5.

Referring also to FIGS. 4–6, auger 190 is operatively coupled to an auger drive cup 192 so that when drive cup 192 is turned, auger 190 also turns. Particularly, an end portion 191 of auger 190 engages slot 195 of drive cup 192 to couple auger 190 to drive cup 192. Drive cup 192 includes a circular ring portion 194 having an inner surface 196 and an outer surface 198. Drive cup outer surface 198 is rotatably coupled to back wall 84. Particularly, drive cup 192 is positioned in an opening 200 in bucket back wall 84. A drive post 202 extends radially from inner surface 196 of ring portion 194. Drive post 202 has a tapered surface 204 that faces away from auger 190. Drive post 202 is located about 180 degrees from end portion 191 of auger 190 when end portion 191 is engaged in slot 195 of drive cup 192.

A drive fork 206 operatively coupled to a drive motor (not shown) includes a base portion 208 having a first end 210 and a second end 212. A first engagement tang 214 extends from first end 210 of base portion 208. First engagement tang 214 includes a first tapered portion 216 extending from a first side edge 218 to a tip 220 and a second tapered portion 222 extending from a second side edge 224 to tip 220. Tip 220 is off centered between side edges 218 and 224. A second tang 226 extends from second end 212 of base portion 208. First tang 214 has a longer length than second tang 226. Second tang 226 includes a tapered portion 228 extending from a first side edge 230 to a second side edge 232. An intersection of tapered portion 228 and second side edge 232 defines a tip 234 of second tang 226.

FIG. 4 shows drive fork 206 before engagement with drive cup 192 while FIG. 5 shows drive fork 206 engaged with drive cup 192. Because of its longer length, first tang 214 engages drive cup 192 first as bucket 168 is moved into position inside freezer compartment 104. Off centered tip 220 forces drive cup 192 to turn counter clockwise as first tang 214 engages auger 190 which is attached to drive cup 192. As ice bucket 168 is pushed into place, drive cup 192 turns until second tang 226 engages drive post 202. Tapered or inclined surface 204 of drive post 202 aids in rotating drive cup 192 counter clockwise as ice bucket 168 reaches its final position inside freezer compartment 104. Also tapered surface 204 of drive post 202 ensures that second tang 226 engages drive cup 192 on opposite side of first tang 214.

Figure 8:
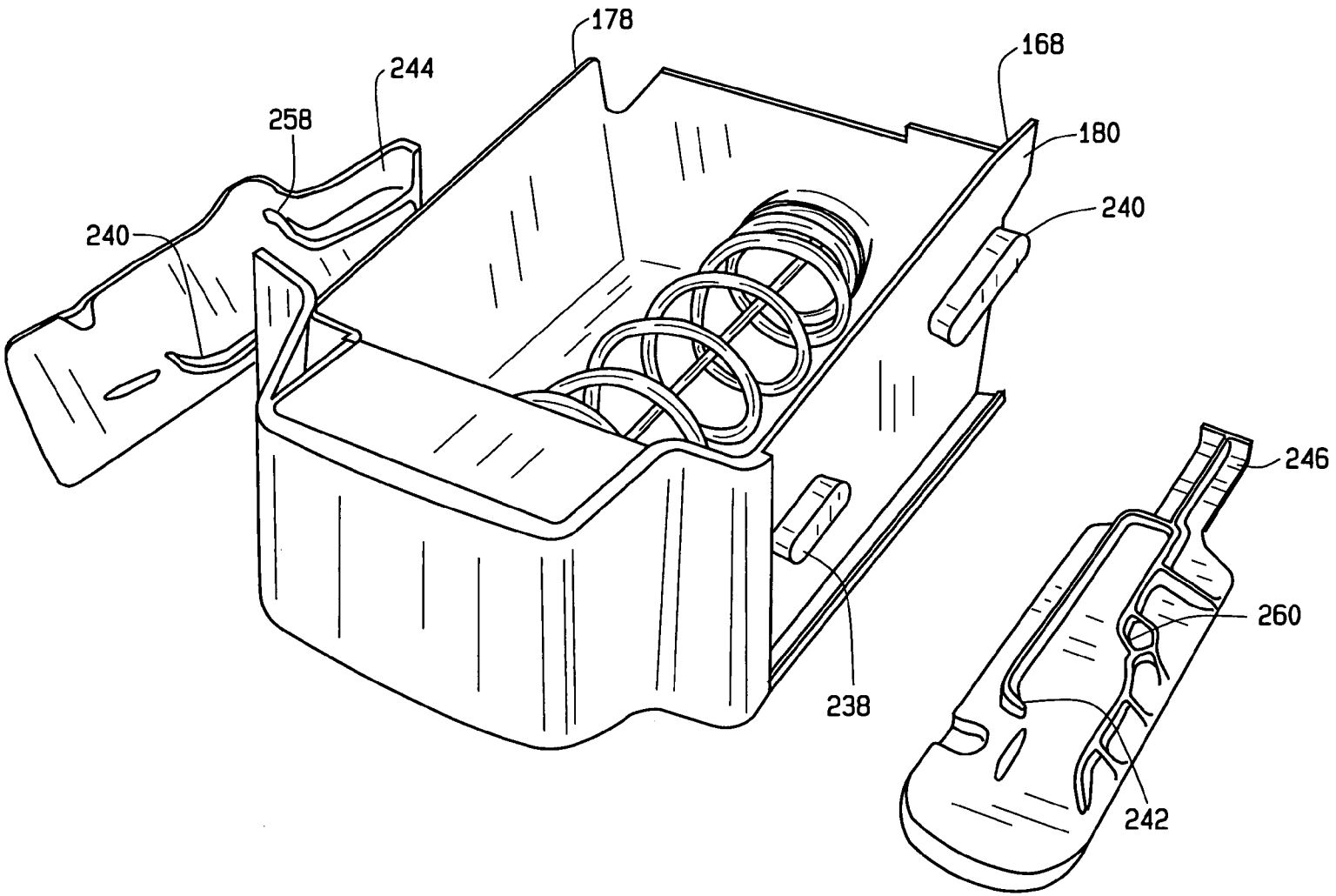
FIG. 8 is a perspective view of the ice bucket shown in FIG. 2 and slide rails on which the ice bucket slides.
Figure 9:
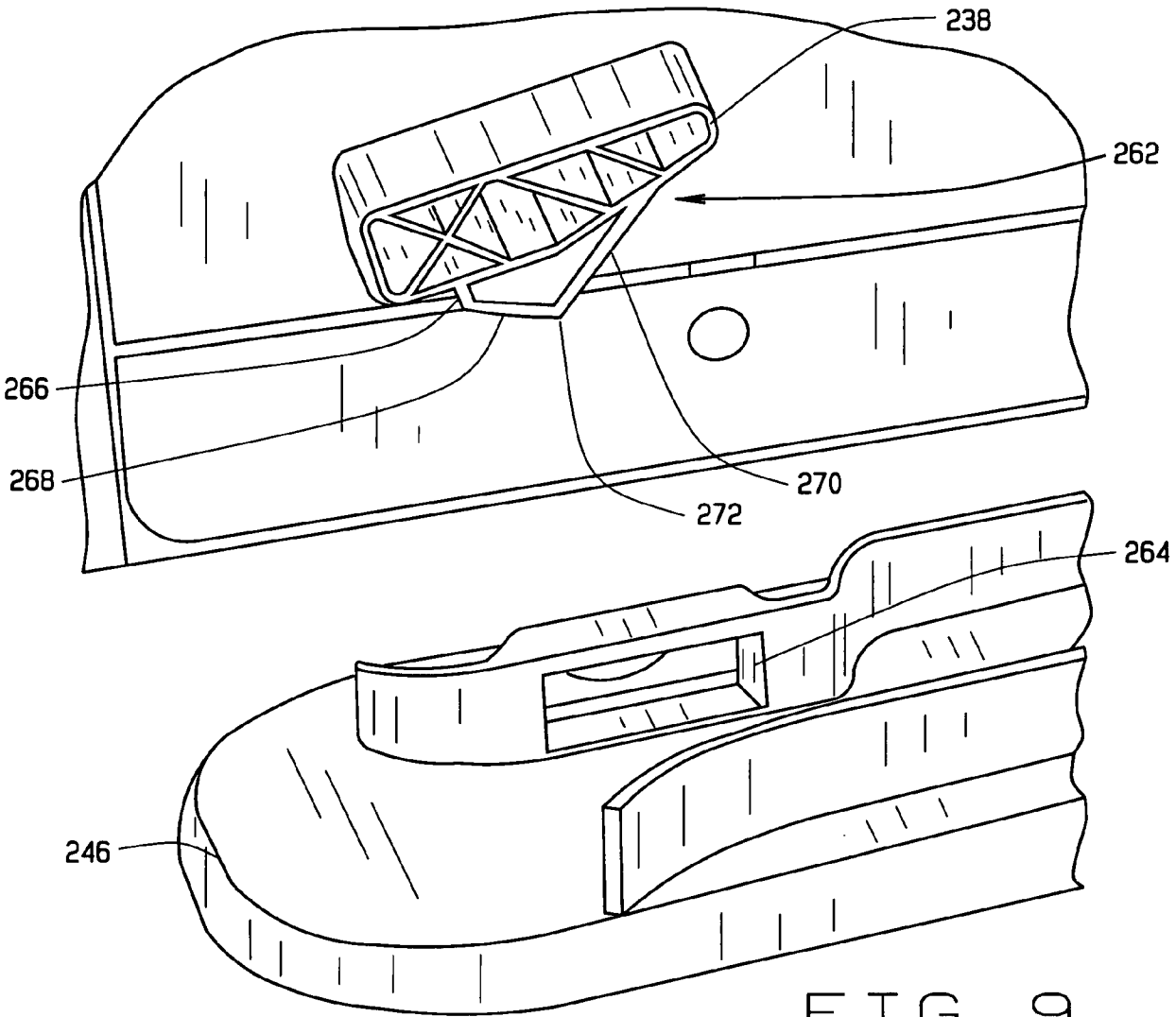
FIG. 9 is an enlarged view of a portion of the ice bucket and slide rail shown in FIG. 8.

Referring again to FIGS. 1, 3, 4, 8 and 9 ice bucket 168 includes front slide nubins 236 and 238 extending from side walls 178 and 180 respectively, and rear slide nubins 240 and 242 extending from side walls 178 and 180 respectively. Front and rear slides 236, 238, 240, and 242 ride or slide in glide tracks 244 and 246 attached to side walls 248 and 250 of freezer compartment 104 As seen in FIG. 4, rear slide nubins 240 and 242 are configured so that ice bucket 168 slopes upward from a back wall 252 of freezer compartment 104 when in a stored position. FIG. 8 shows ice bucket 168 in this upward sloped position. This upward sloped position of ice bucket 168 inside freezer compartment 104 permits ice maker 130 to be mounted at the top of freezer compartment 104 and provide for a maximum amount of usable storage space inside freezer compartment 104. However, in alternate embodiments, ice bucket 168 is mounted in a horizontal position. To permit manual access to ice stored in ice bucket 168, ice bucket 168 can be slid forward with slides 236, 238, 240, and 242 sliding in glide tracks 244 and 246 until rear slides 240 and 242 contact stops 254 and 256 in glide tracks 244 and 246. The front of ice bucket 168 then tilts downward using stops 254 and 256 as pivot points thereby pivoting ice bucket 168 downward until rear slides 240 and 242 contact tilt stop portions 258 and 260 of glide tracks 244 and 246.

Front slide nubins 236 and 238 include a substantially V-shaped engagement portion 262 that is sized to engage a detent 264 in glide tracks 244 and 246. Engagement portion 262 includes a front edge portion 266, a front ramp portion 268, and a rear ramp portion 270. Front and rear ramp portions 268 and 270 join at an apex 272 of engagement portion 262.

To actuate the tilt feature of bucket 168, a user moves ice bucket 168 forward, lifting front nubins 236 and 238 off glide tracks 244 and 246 to disengage from detents 264, until rear nubins 240 and 242 engage stops 254 and 256. The center of gravity of ice bucket 168 permits tilt using glide track stops 254 and 256 as the pivot points and rotates until rear nubins 240 and 242 engage tilt stop portions 258 and 260 of glide tracks 244 and 246. The above described tilt feature is operational when the freezer door is opened only 90 degrees.

Known ice buckets sometimes become unseated during use or auger operation, and drive freezer door open. Also, known ice buckets sometimes do not reliably seat properly, holding the freezer door partially open. The above described front nubin engagement portion 262 and track detent 264 maintains positive seating of ice bucket 168 during operation. The vertical travel from apex 272 to the nubin base prevents unseating of ice bucket 168 during operation. Also, engagement portion 162 ensures that travel by closing the door will positively seat ice bucket 168 into detent 264 if ice bucket 168 has not been seated properly before closing the door. Front ramp portion 268 assisted by gravity, carries engagement portion 262 into detent 264. Front edge portion 264 provides the positive stop for ice bucket 168 so that even if bucket 168 jumps during operation, engagement portion 262 will self-seat into detent 264.

While the invention has been described in terms of various specific embodiments, those skilled in the art will recognize that the invention can be practiced with modification within the spirit and scope of the claims.

What is claimed is:

1. An ice maker assembly for a refrigerator, said ice maker assembly comprising an ice bucket, said ice bucket comprising:

a bottom wall;

opposing side walls extending from said bottom wall;

a front wall;

a back wall, said bottom wall, said side walls, said front wall, and said back wall defining an ice collection cavity;

a plurality of ribs extending from said bottom wall into said ice collection cavity; and a rotatable auger extending between said front and back walls, each said rib extends from a side wall towards said auger.

2. An ice maker assembly in accordance with claim 1 wherein each said rib is tapered from said side wall.

3. An ice maker assembly in accordance with claim 1 further comprising:

an auger drive cup comprising a circular ring portion having an inner surface and an outer surface, said drive cup positioned in an opening in said back wall, said outer surface rotatably coupled to said back wall, said auger drive cup operatively coupled to said auger; and a drive post extending radially from said inner surface of said ring portion, said drive post comprising a tapered surface facing away from said auger.

4. An ice maker assembly in accordance with claim 3 further comprising a drive fork operatively coupled to a drive motor, said drive fork comprising:

a base portion having a first end and a second end;

a first engagement tang extending from said first end of said base portion, said first engagement tang comprising a first tapered portion extending from a first side edge to a tip and a second tapered portion extending from a second side edge to said tip, said tip off centered; and a second tang extending from said second end of said base portion, said first tang longer than said second tang, said second tang comprising a tapered portion extending from a first side edge to a second side edge, an intersection of said tapered portion and said second side edge defining a tip of said second tang.

5. An ice maker assembly in accordance with claim 1 further comprising:

a first and an opposing glide track; and front slide nubins and rear slide nubins extending from said opposing side walls of said ice bucket, said front and rear slide nubins sized to slide in said glide tracks, each said glide tracks comprising a track stop that act as pivot points for tilting said ice bucket, and a tilt stop portion that engages said rear nubin to limit the amount of tilt and hold said ice bucket in place when tilted downward.

6. An ice maker assembly for a refrigerator, said ice maker assembly comprising an ice bucket, said ice bucket comprising:

a bottom wall;

opposing side walls extending from said bottom wall;

a front wall;

a back wall, said bottom wall, said side walls, said front wall, and said back wall defining an ice collection cavity;

a rotatable auger extending between said front and back walls;

an auger drive cup comprising a circular ring portion having an inner surface and an outer surface, said drive cup positioned in an opening in said back wall, said outer surface rotatably coupled to said back wall, said auger drive cup operatively coupled to said auger; and a drive post extending radially from said inner surface of said ring portion, said drive post comprising a tapered surface facing away from said auger.

7. An ice maker assembly in accordance with claim 6 further comprising a drive fork operatively coupled to a drive motor, said drive fork comprising:

a base portion having a first end and a second end;

a first engagement tang extending from said first end of said base portion, said first engagement tang comprising a first tapered portion extending from a first side edge to a tip and a second tapered portion extending from a second side edge to said tip, said tip off centered; and a second tang extending from said second end of said base portion, said first tang longer than said second tang, said second tang comprising a tapered portion extending from a first side edge to a second side edge, an intersection of said tapered portion and said second side edge defining a tip of said second tang.

8. An ice maker assembly in accordance with claim 6 further comprising a plurality of ribs extending from said bottom wall into said ice collection cavity.

9. An ice maker assembly in accordance with claim 6 wherein each said rib extends from a side wall towards said auger.

10. An ice maker assembly in accordance with claim 9 wherein each said rib is tapered from said side wall.

11. An ice maker assembly in accordance with claim 6 further comprising:

a first and an opposing glide track; and front slide nubins and rear slide nubins extending from said opposing side walls of said ice bucket, said front and rear slide nubins sized to slide in said glide tracks, each said glide tracks comprising a track stop that act as pivot points for tilting said ice bucket, and a tilt stop portion that engages said rear nubin to limit the amount of tilt and hold said ice bucket in place when tilted downward.

12. A refrigerator comprising:

a fresh food compartment;

a freezer compartment separated from said fresh food compartment by a mullion, said freezer compartment comprising a back wall;

a first glide track and an opposing second glide track mounted in said freezer compartment; and an ice maker positioned within said freezer compartment, said ice maker comprising an ice bucket slidably mounted in said freezer compartment, said ice bucket tiltable to a downward slope from said back wall to permit access to an ice collection cavity of said ice bucket, said ice bucket comprising front slide nubins and rear slide nubins extending from a first side and an opposing second side of said ice bucket, said front and rear slide nubins sized to slide in said glide tracks, each said glide tracks comprising a track stop that act as pivot points for tilting said ice bucket, and a tilt stop portion that engages said rear nubin to limit the amount of tilt and hold said ice bucket in place when tilted downward; said ice bucket further comprising:

a bottom wall;

opposing side walls extending from said bottom wall;

a front wall;

a back wall, said bottom wall, side walls, front wall, and back wall defining said ice collection cavity;

a plurality of ribs extending from said bottom wall into said ice collection cavity; and a rotatable auger extending between said front and back walls.

13. A refrigerator in accordance with claim 12 wherein each said rib extends from a side wall towards said auger.

14. A refrigerator in accordance with claim 13 wherein each said rib is tapered from said side wall.

15. A refrigerator in accordance with claim 12 further comprising:

an auger drive cup comprising a circular ring portion having an inner surface and an outer surface, said drive cup positioned in an opening in said back wall, said outer surface rotatably coupled to said back wall, said auger drive cup operatively coupled to said auger; and a drive post extending radially from said inner surface of said ring portion, said drive post comprising a tapered surface facing away from said auger.

16. A refrigerator in accordance with claim 15 wherein said ice bucket further comprising a drive fork operatively coupled to a drive motor, said drive fork comprising:

a base portion having a first end and a second end;

a first engagement tang extending from said first end of said base portion, said first engagement tang comprising a first tapered portion extending from a first side edge to a tip and a second tapered portion extending from a second side edge to said tip, said tip off centered; and a second tang extending from said second end of said base portion, said first tang longer than said second tang, said second tang comprising a tapered portion extending from a first side edge to a second side edge, an intersection of said tapered portion and said second side edge defining a tip of said second tang.

* * * * *